United States Patent [19]

Schwalm

[11] Patent Number: 4,494,047

[45] Date of Patent: Jan. 15, 1985

[54] CONVERGENCE DEVICE FOR COLOR-PRODUCING CATHODE RAY TUBE

[76] Inventor: Walter A. Schwalm, 745 Barberry La., Lake Forest, Ill. 60045

[21] Appl. No.: 387,174

[22] Filed: Jun. 10, 1982

[51] Int. Cl.[3] ..... H01J 29/70; H01J 29/76

[52] U.S. Cl. ..... 315/368; 335/212

[58] Field of Search ..... 315/368, 13 C; 358/10; 335/212; 313/412

[56] References Cited

U.S. PATENT DOCUMENTS

| | | | |
|---|---|---|---|
| 3,409,791 | 11/1968 | Ashizaki et al. | 313/412 |
| 3,512,035 | 5/1970 | Egawa et al. | 313/412 |
| 3,852,693 | 12/1974 | Schwalm | 335/212 |
| 3,858,134 | 12/1974 | Budd | 335/212 |
| 3,942,146 | 3/1976 | La Belle | 335/212 |

*Primary Examiner*—Theodore M. Blum

*Attorney, Agent, or Firm*—George H. Gerstman

[57] ABSTRACT

An electron beam convergence device is provided for a cathode ray tube of the type including an electron beam gun for developing three electron beams disposed on the screen in linear array. First and second rods formed of magnetic material and each including a plurality of pole pairs disposed along the rod are tangentially positioned on opposite sides of the neck of the cathode ray tube, with both axial (i.e., linear) and rotatable motion of the first and second rods being permitted with respect to the cathode ray tube. Axial and rotatable motion of the first rod are operable to adjust the left beam without substantial movement of the center and right beams. Axial and rotatable motion of the second rod are operable to adjust the right beam without substantial movement of the left and center beams.

A purity adjustment device may be provided which includes a manually adjustable rod formed of magnetic material and a pair of pole pieces extending from the rod and curving around a portion of the neck of the cathode ray tube to provide magnetic lines of force which are substantially straight with respect to the cathode ray tube.

10 Claims, 6 Drawing Figures

FIG. 1
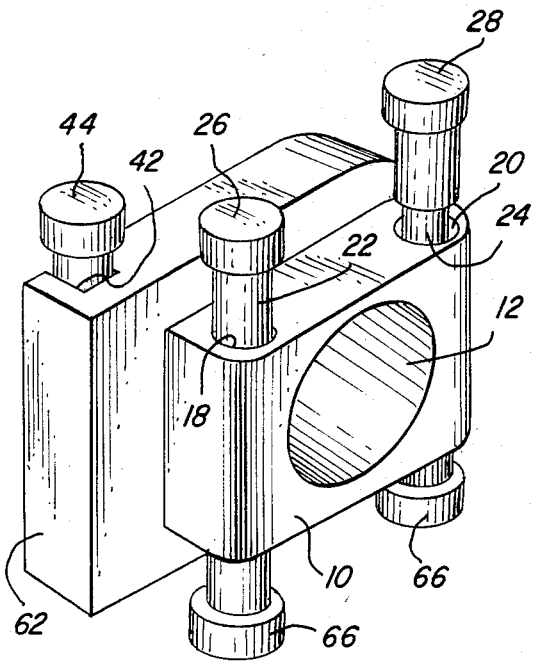
FIG. 2
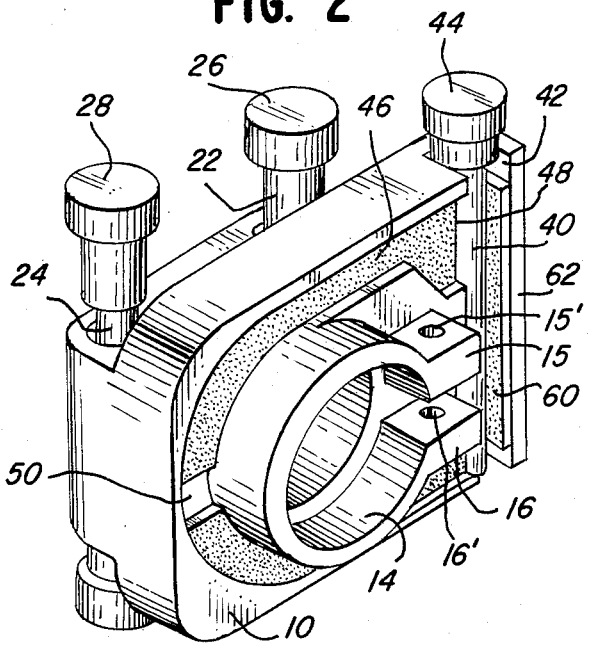
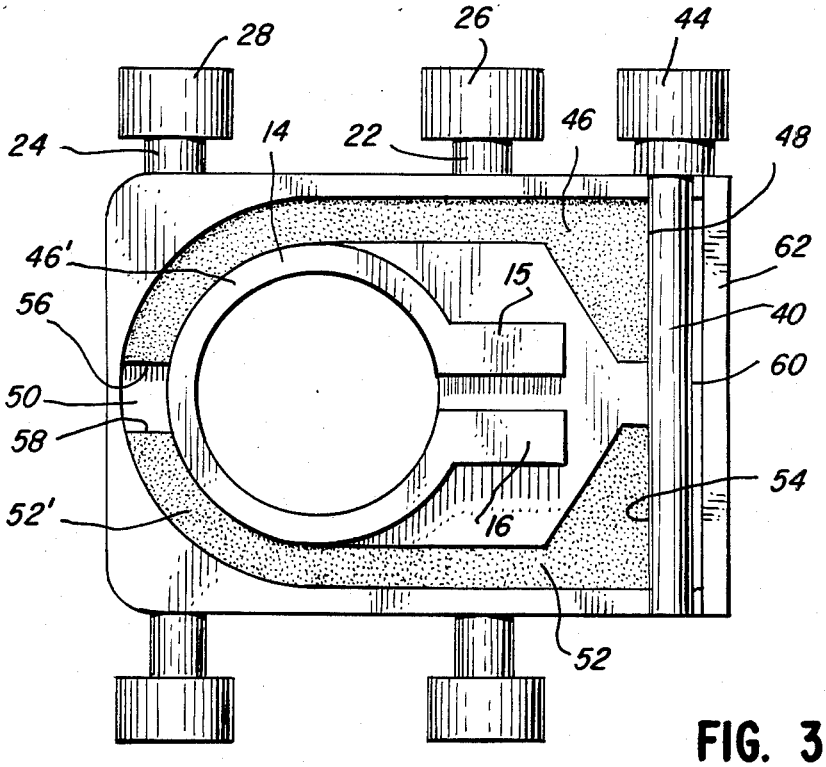
FIG. 3

CONVERGENCE DEVICE FOR COLOR-PRODUCING CATHODE RAY TUBE

BACKGROUND OF THE INVENTION

This invention relates to an improved electron beam convergence device and an improved purity adjustment device for color television tubes.

One type of cathode ray tube conventionally used in a color television receiver includes an electron beam gun generally designated as an "in-line gun" for developing three electron beams disposed on the screen in linear array. The cathode ray tube also includes a slotted shadow mask and a screen formed of red, green and blue phosphor dots. The shadow mask is operable to aid each electron beam in impinging only upon the phosphor dots of an assigned hue. While the center beam is used as a reference, the outer beams are moved in a manner so that they will cross the reference (center) beam at the shadow mask. This operation is generally designated as "converging" which requires selected movement of one of the beams, but not the others. If when a selected beam is moved, another beam moves along with it, such "chasing" results in difficulty in achieving proper convergence.

It is, therefore, an object of the present invention to alleviate "chasing" and to permit proper convergence by providing a device which permits movement of only one beam at a time.

One prior art type of convergence device for in-line guns comprises three pairs of rings carried by a member which attaches to the neck of the cathode ray tube. The first pair of rings has three pole pairs, with each of the two rings being rotatable in opposition to each other and also movable as a unit. The second pair of rings is similar to the first pair of rings, but each ring has two pole pairs instead of three pole pairs. The third pair of rings are for purity adjustment. Each ring only has one pole pair and each is rotatable in opposition to the other.

It has been found that the aforementioned convergence device is relatively difficult to operate to converge properly.

Another type of convergence device for in-line guns is sold by Schwalm Electronics, Inc., Highland Park, Ill., and comprises four parallel ferrite rods, each of which is rotatable. Two of the rods are required to control vertical beam positioning and the other two rods are required to control horizontal beam positioning.

It is an object of the present invention to provide a convergence device which is simple in construction and operation, and is economical to manufacture.

A further object of the invention is to provide a convergence device in which rod-like magnets may be both axially and rotatably moved to adjust one of the electron beams at a time.

In order for each electron beam to impinge only upon its own corresponding phoshor dots, "purity" adjustments are often necessary. It has been found that most effective purity adjustment is achievable when the magnetic lines of force provided by a purity magnet device are relatively straight with respect to the cathode ray tube. To this end, it is an object of the invention to provide a purity adjustment device which is simple in construction, efficient to manufacture and provides substantially straight magnetic lines of force with respect to the cathode ray tube.

Other objects and advantages of the present invention will become apparent as the description proceeds.

SUMMARY OF THE INVENTION

In accordance with the present invention, an electron beam convergence device is provided for a cathode ray tube of the type including an electron beam gun for developing three electron beams disposed on the screen in linear array. The device comprises a first rod formed of magnetic material and including a plurality of pole pairs disposed along the first rod. A second rod is formed of magnetic material and includes a plurality of pole pairs disposed along the second rod. Means are provided for positioning the first and second rods on opposite sides of the neck of the cathode ray tube and for permitting both linear and rotatable motion of the first and second rods with respect to the cathode ray tube.

In one embodiment, the positioning means comprises a base member defining openings for receiving the rods and for placing the rods in substantial tangential arrangement with respect to the cathode ray tube.

In one embodiment, the base member carries purity adjustment means which comprise a manually adjustable rod formed of magnetic material and a pair of pole pieces extending from the rod and curving around a portion of the neck of the cathode ray tube.

In the illustrative embodiment, the manually adjustable rod of the purity adjustment means is rotatable and includes a plurality of pole pairs disposed along it. The pole pieces each have one end which abuts the manually adjustable rod and each extends from the one end past the neck of the cathode ray tube and curves toward the other pole piece but is spaced from the other pole piece.

A more detailed explanation of the invention is provided in the following description and claims, and is illustrated in the accompanying drawings.

BRIEF DESCRIPTION OF THE DRAWINGS

FIG. 1 is a front perspective view of a convergence device constructed in accordance with the principles of the present invention;

FIG. 2 is a rear perspective view thereof;

FIG. 3 is a rear elevational view thereof;

DETAILED DESCRIPTION OF THE ILLUSTRATIVE EMBODIMENT

Figure 4:
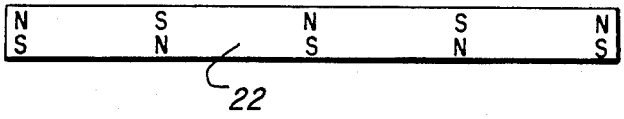
FIG. 4 is a schematic view of one of the magnetic rods of the convergence device of FIGS. 1–3.

Referring to the drawings, a base member 10 formed of a non-magnetic material, such as plastic, is shown defining an opening 12 for receiving the neck of an in-line gun type cathode ray tube. Base member 10 is attached to the cathode ray tube by means of a suitable clamping member 14 having ends 15, 16 which are moved closer together by means of a bolt and nut arrangement (not shown) which extends through openings 15', 16'.

Base member 10 defines openings 18, 20 extending therethrough, which frictionally receive a first ferrite rod 22 and a second ferrite rod 24. Ferrite rods 22 and 24 are identical to each other and, as shown in FIG. 4, include a plurality of pole pairs (preferably five pole pairs) disposed along their length. Each of the ferrite rods 22, 24 is provided with a suitable handle 26, 28, respectively, for permitting simple manual adjustment thereof.

Openings 18 and 20 are located on opposite sides of opening 12 and are located in a manner to position rods 22, 24 as closely as possible to opening 12, so that the ferrite rods will be in substantial tangential arrangement with respect to the neck of the cathode ray tube. If desired, openings 18 and 20 communicate with opening 12 so that a portion of rod 22 and rod 24 will be located inside of opening 12, thereby permitting the ferrite rods to have actual physical contact with the neck of the cathode ray tube.

Handles 26, 28 and openings 18, 20 cooperate to permit ferrite rods 22, 24 to move both rotatably and axially with respect to base member 10. It has been found that such rotatable and axial movement of the ferrite rods alleviates the chasing problem which occurs in certain prior art convergence devices.

Figure 5:
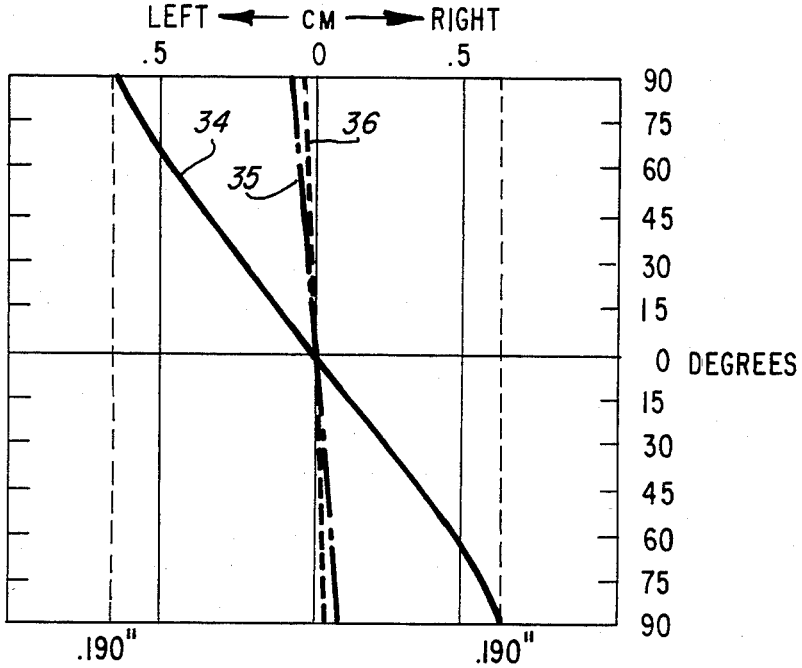
FIG. 5 is a graph showing the beam movement in response to rotation of one of the magnetic rods.
Figure 6:
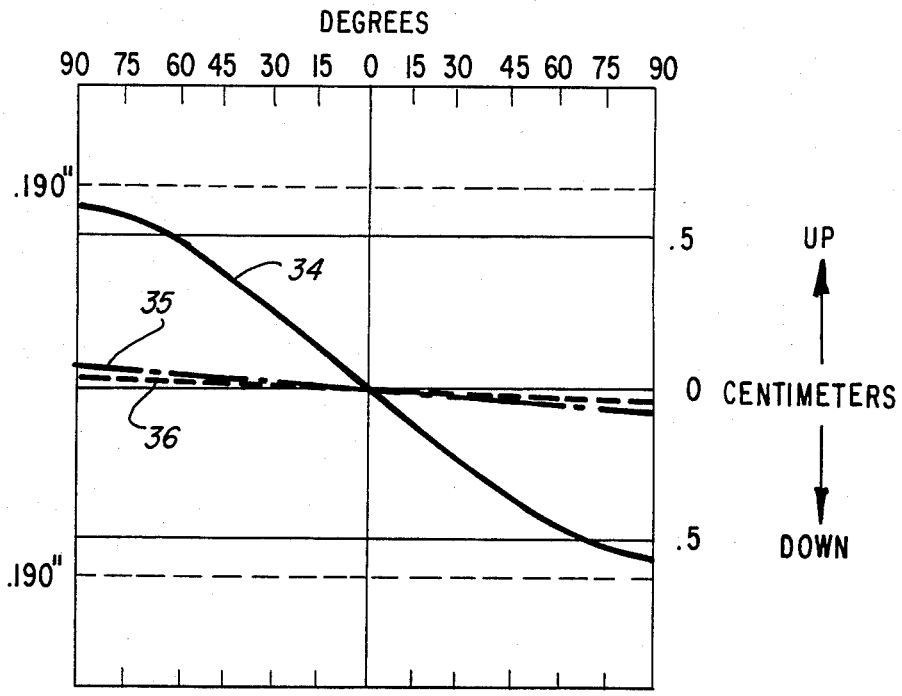
FIG. 6 is a graph showing beam movement in response to rotation of one of the magnetic rods after being displaced axially.

In FIG. 5, the beam movement on the screen is shown with respect to rotational movement of ferrite rod 22. In the illustrative embodiment, a cathode ray tube is used in which the red beam 35 is the center beam. Beam 34 is the green beam which moves substantially when the ferrite rod 22 is rotated, while red beam 35 and blue beam 36 remain substantially constant. Likewise, as shown in FIG. 6, the movement of green beam 34 is substantial during axial movement of ferrite rod 22, while red beam 35 and blue beam 36 remain substantially constant.

When the ferrite rod 24 is moved rotatably and axially, blue beam 36 moves substantially while red beam 35 and green beam 34 remain substantially constant.

In order to provide effective purity adjustment, a ferrite rod 40 is provided within a slot 42 defined by base member 10. Ferrite rod 40 preferably includes two pole pairs along its length and has a handle 44 attached to it or formed with it for permitting simple rotational movement of the rod 40 by an operator. A soft iron pole piece 46 having one end 48 abutting rod 40 is fitted within a recess 50 defined by base member 10 and a soft iron pole piece 52 having an end 54 abutting rod 40 is also carried within recess 50. Pole pieces 46 and 52 each extend from rod 40 as shown most clearly in FIG. 3, and have portions 46' and 52' which curve around clamp 14, but have ends 56, 58 which are spaced from each other within recess 50. It has been found that by providing such a curvilinear system as shown in FIG. 3, the magnetic lines of force from pole pieces 46, 52 which traverse the cathode ray tube are substantially straight, thereby providing an effective purity adjustment when handle 44 is turned to rotate rod 40. Thus it was unexpectedly found that the magnetic field would be relatively straight transversing the cathode ray tube if portions 46', 52' were curved in the manner shown in FIG. 3.

Another soft iron pole piece 60, having rectilinear form, is positioned within recess 42 in a manner snugly between rod 40 and the end 62 of base member 10, so as to abut rod 40 and sandwich rod 40 between pole pieces 60, 46 and 52. Pole pieces 60, 46 and 52 may be attached to the base member 10 by any suitable attaching means, such as cement, metal fasteners or a clamping system provided by the base member itself.

If desired, additional handles, such as handles 66, may be connected or formed with opposite ends of the ferrite rods. Further, the number of pole pairs disposed along the ferrite rods may be varied, although five pole pairs for ferrite rods 22 and 24 and two pole pairs for ferrite rod 40 are preferred.

It is to be understood that various modifications and substitutions may be made by those skilled in the art without departing from the novel spirit and scope of the present invention.

I claim:

1. A purity adjustment device for a color television tube which includes an electron beam gun for developing three electron beams disposed on the screen in linear array, which comprises:

a base member;

means for connecting said base member to the color television tube;

a manually-adjustable rod formed of magnetic material carried by said base member, said manually-adjustable rod being rotatable and including a plurality of pole pairs disposed along it;

a pair of pole pieces extending from said manually-adjustable rod and curving in a manner to provide substantially straight magnetic lines of force across said color television tube, said pole pieces each having one end which is adjacent to said manually-adjustable rod and each is adapted to extend from said one end past the neck of the color television tube and to curve toward the other pole piece but being spaced from the other pole piece; and a third pole piece abutting said manually-adjustable rod and sandwiching said manually-adjustable rod between said third pole piece and said first and second pole pieces.

2. An electron beam convergence device for a cathode ray tube which includes an electron beam gun for developing three electron beams disposed on the screen in linear array, which comprises: a first elongated cylindrical rod formed of magnetic material and including at least five pole pairs disposed along said first rod; a second elongated cylindrical rod formed of magnetic material and including at least five pole pairs disposed along said second rod; a base member defining openings for receiving said rods and adapted for positioning said first and second rods on opposite sides of the neck of the cathode ray tube, said base member being operable to permit both linear and rotatable motion of said first and second rods with respect to said cathode ray tube and being operable to position said rods in substantially tangential arrangement with respect to the neck of said cathode ray tube; said linear motion being in the direction of the cylindrical axes of said rods and said rotatable motion being around the cylindrical axes of said rods; means for clamping said base member to the neck of said cathode ray tube; and said first rod being operable when moved linearly and rotatably to adjust the left eletron beam without substantial movement of the center and right electron beams; and said second rod being operable when moved linearly and rotatably to adjust the right electron beam without substantial movement of the center and left electron beams.

3. An electron beam convergence device for a cathode ray tube which includes an electron beam gun for developing three electron beams disposed on the screen in linear array, which comprises: a base member; means for connecting said base member to the neck of said cathode ray tube; a first elongated cylindrical rod formed of magnetic material and including at least five pole pairs disposed along said first rod; a second elongated cylindrical rod formed of magnetic material and including at least five pole pairs disposed along said second rod; said base member including first means for carrying said first rod and second means for carrying said second rod; said first carrying means being located on said base member to position said first rod on one side of said neck and substantially tangentially to said neck; said second carrying means being located on said base member to position said second rod on an opposite side of said neck and substantially tangentially to said neck, said carrying means permitting both linear and rotatable motion of said rods with respect to said base member, said linear motion being in the direction of the cylindrical axes of said rods and said rotatable motion being around the cylindrical axes of said rods.

4. A device as described in claim 3, wherein said first rod is operable to adjust one of said three electron beams other than the center beam and said second rod is operable to adjust another of said three electron beams other than the center beam

5. A device as described in claim 3, wherein said first rod is operable when moved linearly and rotatably to adjust the left beam without substantial movement of the center and right beams and said second rod is operable when moved linearly and rotatably to adjust the right beam without substantial movement of the center and left beams.

6. A device as described in claim 3, including purity adjustment means carried by said base member, said purity adjustment means comprising manually adjustable magnetic means.

7. A device as described in claim 3, including purity adjustment means carried by said base member, said purity adjustment means comprising a manually adjustable rod formed of magnetic material and a pair of pole pieces extending from said rod and curving around a portion of the neck of said cathode ray tube.

8. A device as described in claim 7, said manually adjustable rod being rotatable and including a plurality of pole pairs disposed along it, said pole pieces each having one end which is adjacent to said manually adjustable rod and each extending from said one end past the neck of the cathode ray tube and curving toward the other pole piece but being spaced therefrom.

9. A device as described in claim 8, including a third pole piece abutting said manually adjustable rod and sandwiching said manually adjustable rod between said third pole piece and said first and second pole pieces.

10. A device as described in claim 3, wherein said carrying means includes the walls of said base member which define openings for receiving said rods.

* * * * *